US007607445B2

(12) United States Patent
von Dewitz et al.

(10) Patent No.: US 7,607,445 B2
(45) Date of Patent: Oct. 27, 2009

(54) POLE FOR HOLDING AND/OR SUPPORTING TENT SHEETS

(75) Inventors: Albrecht von Dewitz, Tettnang (DE); Hans-Thomas Langowski, Achberg (DE); Hansjörg Egger, Tettnang-Siggenweiler (DE); Tobias Fugel, Wasserburg (DE); Daniel Gebel, Wellheim (DE); Matthias Kimmerle, Tettnang (DE)

(73) Assignee: VauDe Sport GmbH & Co. KG, Tettnang (DE)

( * ) Notice: Subject to any disclaimer, the term of this patent is extended or adjusted under 35 U.S.C. 154(b) by 23 days.

(21) Appl. No.: 11/825,679

(22) Filed: Jul. 9, 2007

(65) Prior Publication Data

US 2008/0053508 A1 Mar. 6, 2008

(30) Foreign Application Priority Data

Jul. 10, 2006 (EP) ..... 06014217

(51) Int. Cl.
*E04H 15/60* (2006.01)
*E04H 15/44* (2006.01)

(52) U.S. Cl. ..... 135/114; 135/138; 135/124; 135/120.3

(58) Field of Classification Search ..... 135/121, 135/124, 125, 126, 128, 136, 138, 156, 114, 135/115, 119, 120.3; 403/332, 375; 52/848; 449/107

See application file for complete search history.

(56) References Cited

U.S. PATENT DOCUMENTS

| | | | | |
|---|---|---|---|---|
| 1,857,434 | A * | 5/1932 | Cole | 254/390 |
| 5,261,436 | A * | 11/1993 | Funk | 135/156 |
| 5,901,727 | A * | 5/1999 | Kramer et al. | 135/136 |
| 6,415,806 | B1 * | 7/2002 | Gillis | 135/124 |
| 6,866,055 | B2 * | 3/2005 | Scherer | 135/125 |

FOREIGN PATENT DOCUMENTS

GB 2148967 A * 6/1985

* cited by examiner

*Primary Examiner*—David Dunn
*Assistant Examiner*—Danielle Jackson
(74) *Attorney, Agent, or Firm*—Pandiscio & Pandiscio

(57) ABSTRACT

In a pole (11) for holding and/or supporting tent sheets (3, 5) that can be assembled from interconnecting segments (15) to make an arch (12), the individual segments (15) can be connected together by intermediate elements (16) that can be inserted into them and a tensioning element (21) can be suspended from each of these intermediate elements (16) on the inside of an arch (12), with the ability for the tensioning elements (21) to be tensioned in the area of the ends (13, 14) of the pole (11). This configuration means that the tent (1) is always stable and its interior is not partitioned off or subdivided by tensioning straps. Also, the tent (1) can be pitched and struck within a short period of time (FIG. 1).

10 Claims, 6 Drawing Sheets

POLE FOR HOLDING AND/OR SUPPORTING TENT SHEETS

Figure 1:
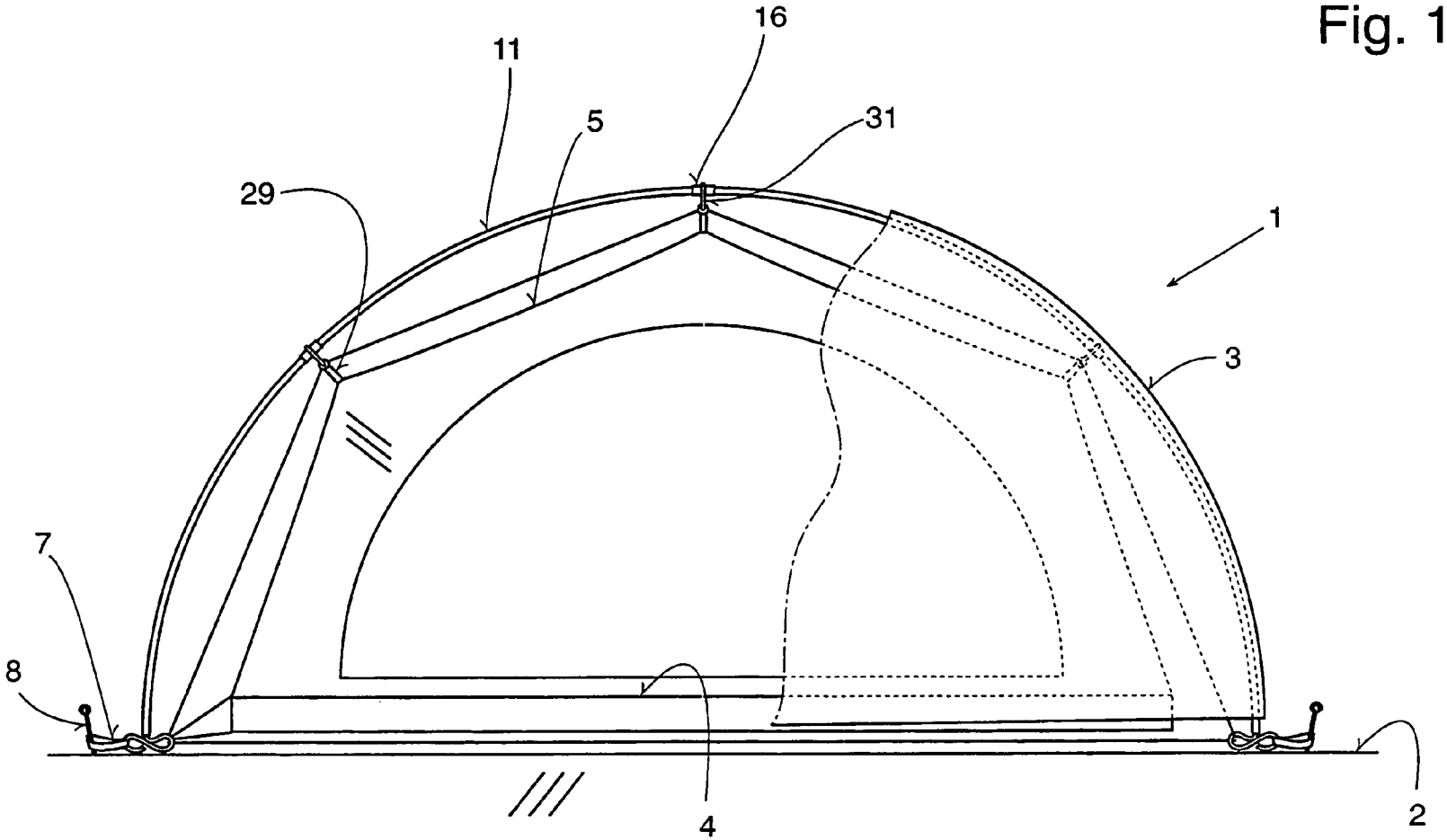

The present invention relates to a pole for holding and/or supporting tent sheets comprising several segments that can be connected together to form an arch that can be supported with both ends on the ground.

In a tent pole of prior art, a cord made from an elastic material such as rubber is passed through the segments that are interconnected when setting up the tent, with the ends of the cord being securely connected to the outermost segments and the cord having considerable elastic properties in the axial direction. The tent pole is therefore easy to dismantle in order to store the segments next to one another in a small space, e.g. in a rucksack or a knapsack, however on the other hand the assembled segments do not offer any considerable level of security for the pole that is usually passed through a channel in the tent.

The tent pole offered by the company Vango under the name "Tension Bund System" and presented in the "Tents 98" catalogue requires the attachment of two tensioning belts in the middle of an arch in order to increase its stability, with these belts running diagonally through the interior of the tent and attached to the ends of the arch. Although this method does provide a high level of resistance to wind forces acting on the tent, with the result that the tent is not unduly deformed, the tensioning belts that require individual tensioning do divide up the interior of the tent into two sections and thereby significantly encumber the use of the tent. Furthermore, attaching the tensioning straps is a time-consuming procedure that requires skill to accomplish.

The task of the present invention is therefore to configure a tent pole of the aforementioned type in such a way that, whilst only requiring a slight amount of additional setup work to be performed, the tent will always be highly sturdy and capable of being used even in a storm. At the same time, the interior of the tent should not be partitioned off or divided up by tensioning belts, whilst it should also be possible to pitch and strike a tent in a short time and without any difficulties. Furthermore, the present invention should ensure that the level of stability can easily be adapted to the particular weather conditions and that easy handling is provided when pitching and striking a tent.

In accordance with the present invention, this is achieved in a pole of the aforementioned type in that the individual segments can be connected together by intermediate elements that can be inserted into or pushed onto them, and that a tensioning element can be hung from each of the intermediate elements on the inside of an arch, with the possibility for the tensioning element to be tensioned against the pole in the area at the ends of the pole, against a base of the tent and/or against the ground.

In a straightforward embodiment, the intermediate element can be configured as a shaped part with its outer contour preferably adapted to the segments, with the ability for both of its ends to be inserted into or pushed onto the adjacent segments, in which case the shaped part should be provided with a constriction in the form of a circumferential groove in order to accommodate a holding element attached to the tensioning element.

In a straightforward embodiment, the tensioning element can be configured as a pulling element that is rigid in the longitudinal direction, e.g. in the form of a cord or a wire cable that is suspended from the intermediate elements of the pole and is tensioned against both ends.

However, it is also possible for the tensioning element to be formed by two or more pulling elements that are rigid in the longitudinal direction, which are suspended from alternate intermediate elements of the pole and are tensioned at their ends, preferably jointly.

Furthermore, it is advantageous for the pulling elements to be fixed on both sides of the holding elements using clamping sleeves or cord stoppers that are preferably attached in an adjustable manner, and in the case of a tensioning element consisting of two or more pulling elements, for the pulling elements to be attached to one connector at each of their intersection points, and if necessary be tensioned using these.

According to a different embodiment, the tensioning element can also be composed of a plurality of pieces of textile fabric which should be triangular in shape, be enclosed completely or partially by belt straps and be connected to one another using these straps. The pieces of textile fabric can also be formed by nets in this case.

The holding elements for attaching the tensioning elements to the intermediate elements of the pole should be configured in the form of hooks that can be moved to a limited extent at one end or are firmly connected to the tensioning elements, and which can have their open ends hooked onto the constriction in the intermediate elements.

For the purposes of locking the pole onto a base, it is advantageous for a pointed hook to be pushed into or onto each of the outer segments of the pole, by means of which the tent can be anchored and to allow a tensioning band connecting the ends of the arch together to be attached to the tensioning elements.

Each of the tensioning elements can be provided with a tensioning piece for adjusting the level of tension. Also, a tent sheet can be suspended from the tensioning elements of the pole and/or a tent sheet can be placed on top of the pole.

If a pole is configured in accordance with the present invention, it becomes a straightforward matter to tension the arch of the pole using the tensioning elements with the effect that a high level of stability is provided, even at high wind speeds. The complexity of the setup work required to achieve this is extremely slight, whilst nevertheless the tensioning elements configured in various ways provide a high level of resistance, in particular against forces acting on the outside of a tent supported in this way.

Furthermore, it is advantageous that the interior of the tent is not subdivided by the tensioning elements. Instead, the tensioning elements run close to the arch of the tent and therefore they do not take up any useful space in the interior of the tent. Also, the pole configured in accordance with the present invention can be used in various different ways by placing the tent sheet onto the pole and/or suspending the tent sheet from underneath the pole. Furthermore, the process of pitching a tent is made easier and quicker because a stable base or hold is achieved as soon as one pole arch has been set up and tensioned. Also, the stiffness of the individual arches of a tent pole can be adapted to the particular requirements by means of the tensioning elements, which means the tent is always guaranteed to offer a high level of stability combined with ease of handling when it is being pitched and struck.

Figure 3:
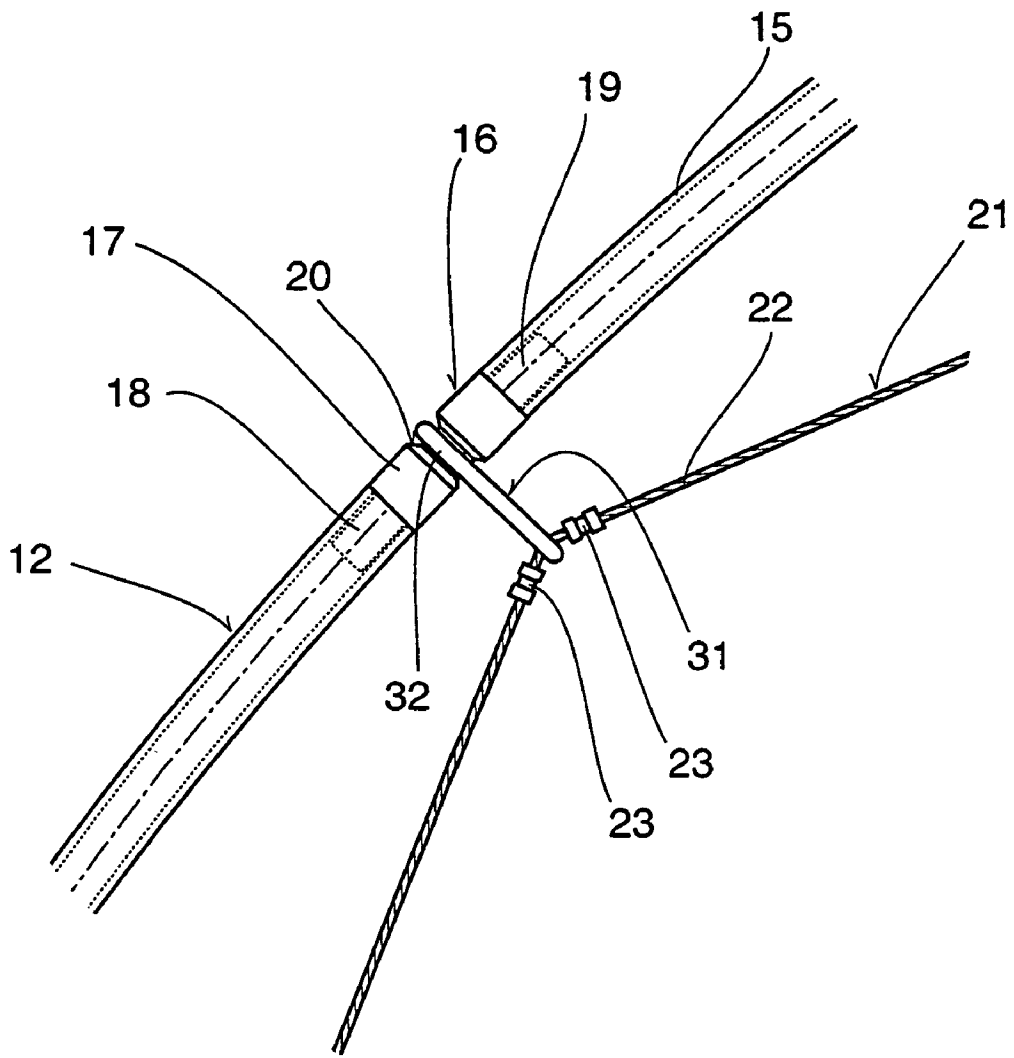
Figure 4:
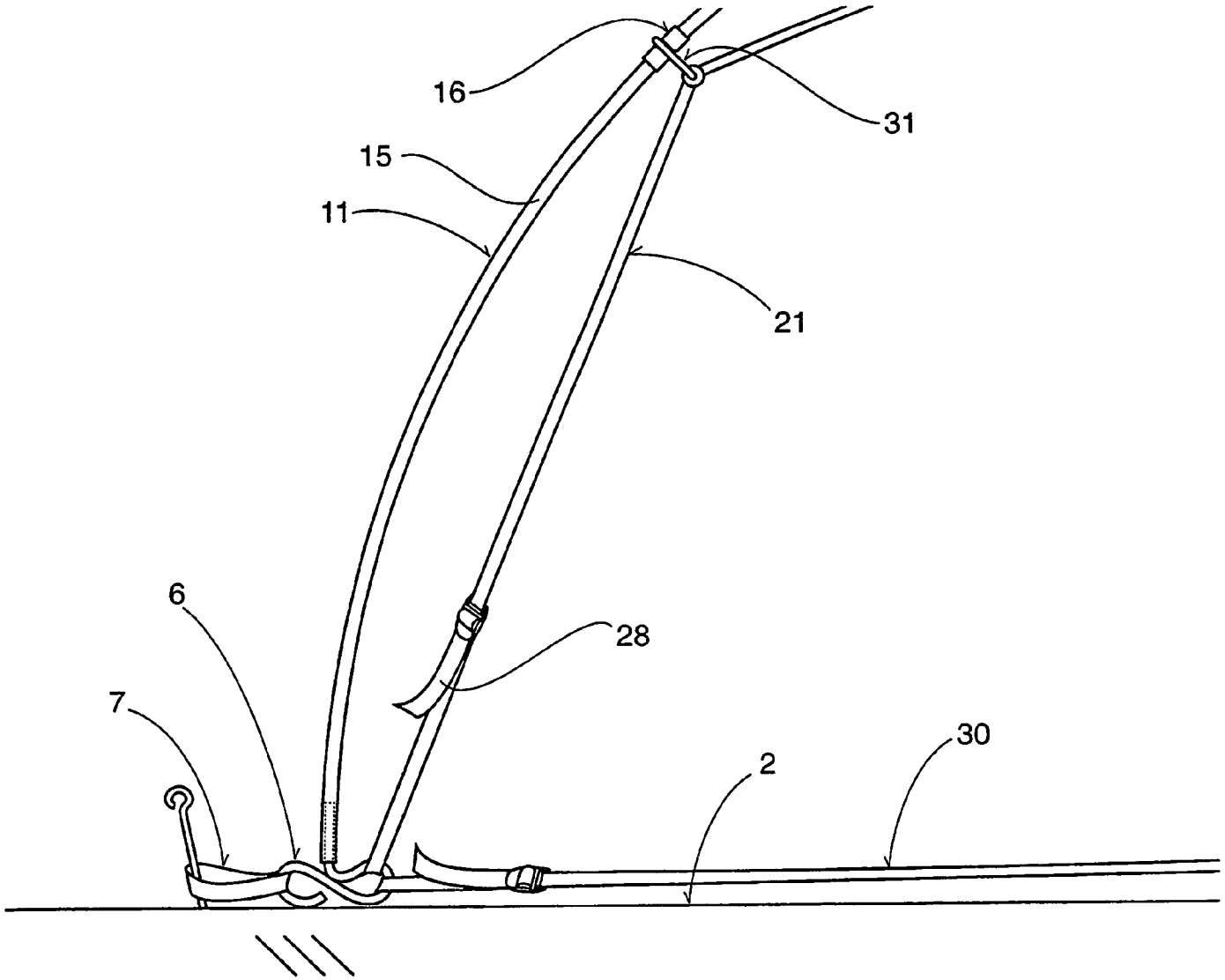
Figure 5:
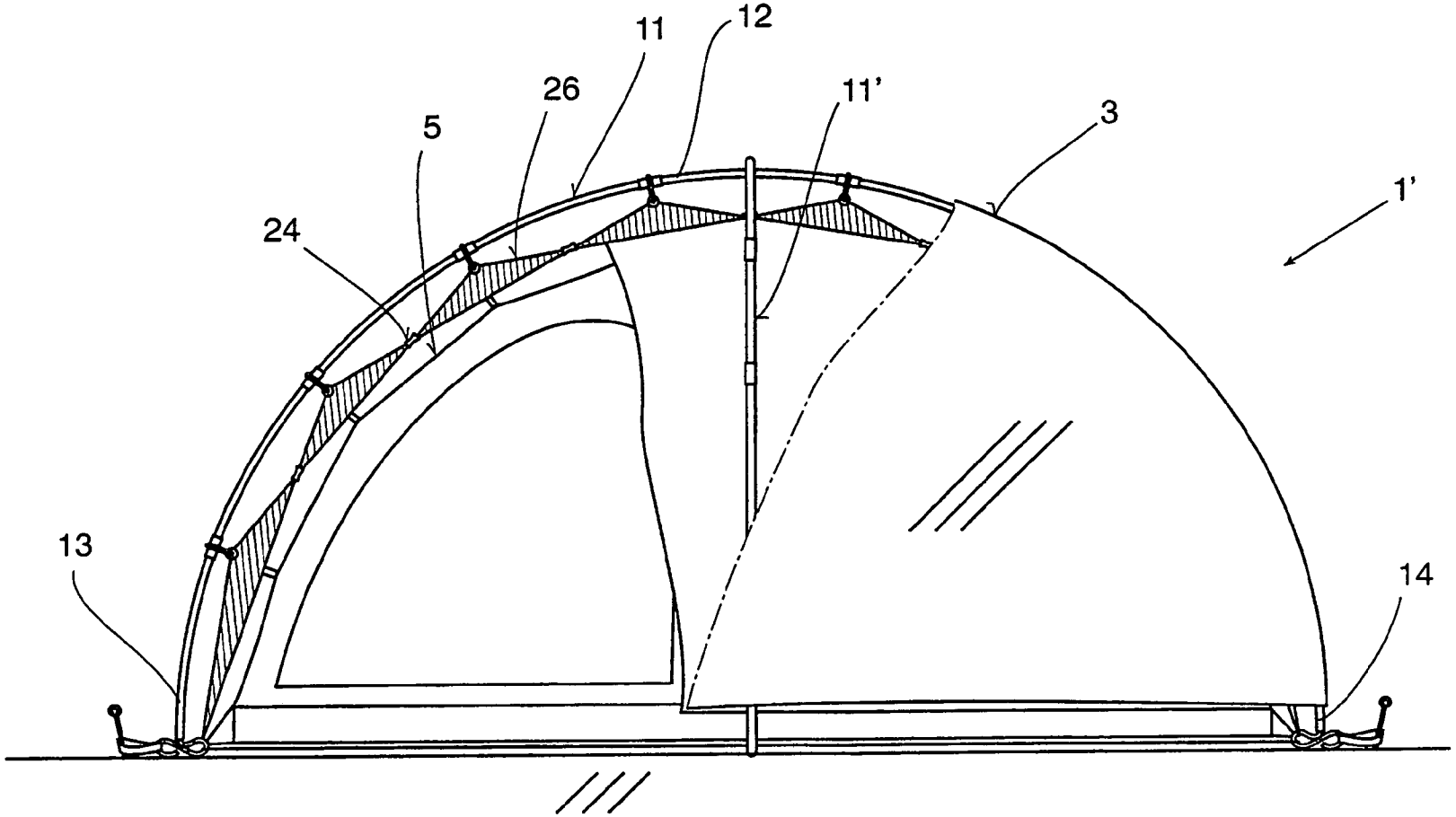
Figure 6:
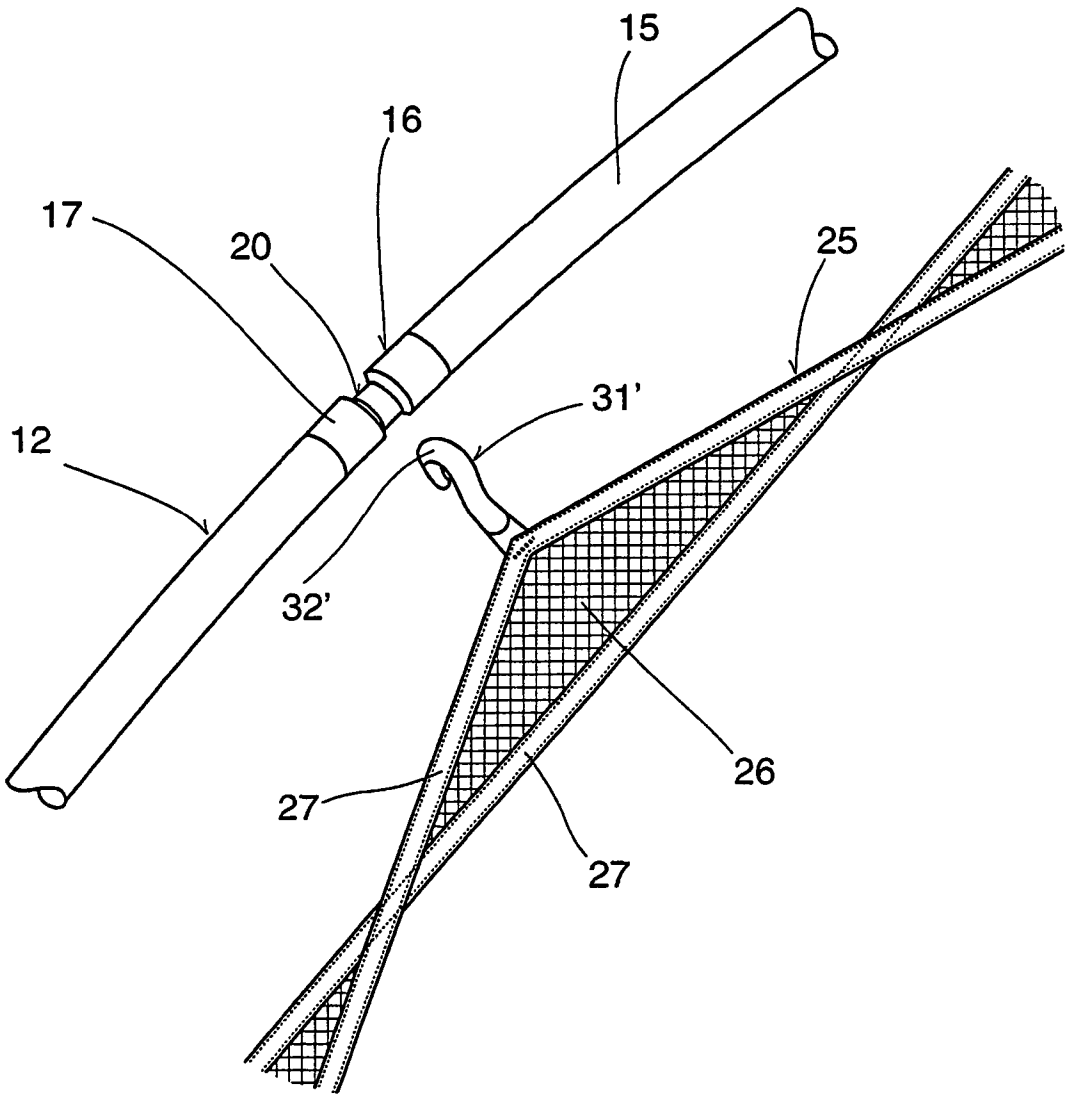

The drawing shows certain sample embodiments of a pole configured in accordance with the present invention, the details of which are explained below. In the drawing, FIG. 1 shows a tent supported by an assembled and tensioned pole, FIG. 2 shows a configuration variant for tensioning the tent pole in accordance with FIG. 1, FIG. 3 shows the suspension of a tensioning element for the tent pole in accordance with FIGS. 1 and 2, in a magnified view, FIG. 4 shows the anchoring of the tent pole and the tensioning element for the tent in accordance with FIG. 1, FIG. 5 shows a tensioning element composed of pieces of textile fabric for the tent in accordance with FIG. 1 and FIG. 6 shows a section of FIG. 5, in a magnified view.

The tent shown only in part in FIG. 1 and identified with 1 is supported on the ground 2 and held up by means of a pole 11 that is composed of individual segments 15 to allow it to be disassembled for transport. The tent pole 11 forms an arch 12 when assembled and the ends 13 and 14 of the arch 12 are anchored on the ground 2. The tent sheet 3 forming the tent 1 in this case is placed over one or more arches 12 of the tent pole 11, and is also fixed onto the ground 2 together with the trough-shaped tent base 4.

The segments 15 next to one another are connected together by intermediate elements 16 that are designed as shaped parts 17 adapted to the outer contour of the segments 15. The intermediate elements 16, as is shown in particular in FIG. 3, have both their offset ends 18 and 19 inserted into the segments 15 that take the form of hollow segments, in addition the shaped parts 17 have a constriction 20 located approximately in their middle in the form of a circumferential groove into which it is possible to hook holding elements 31.

Figure 2:
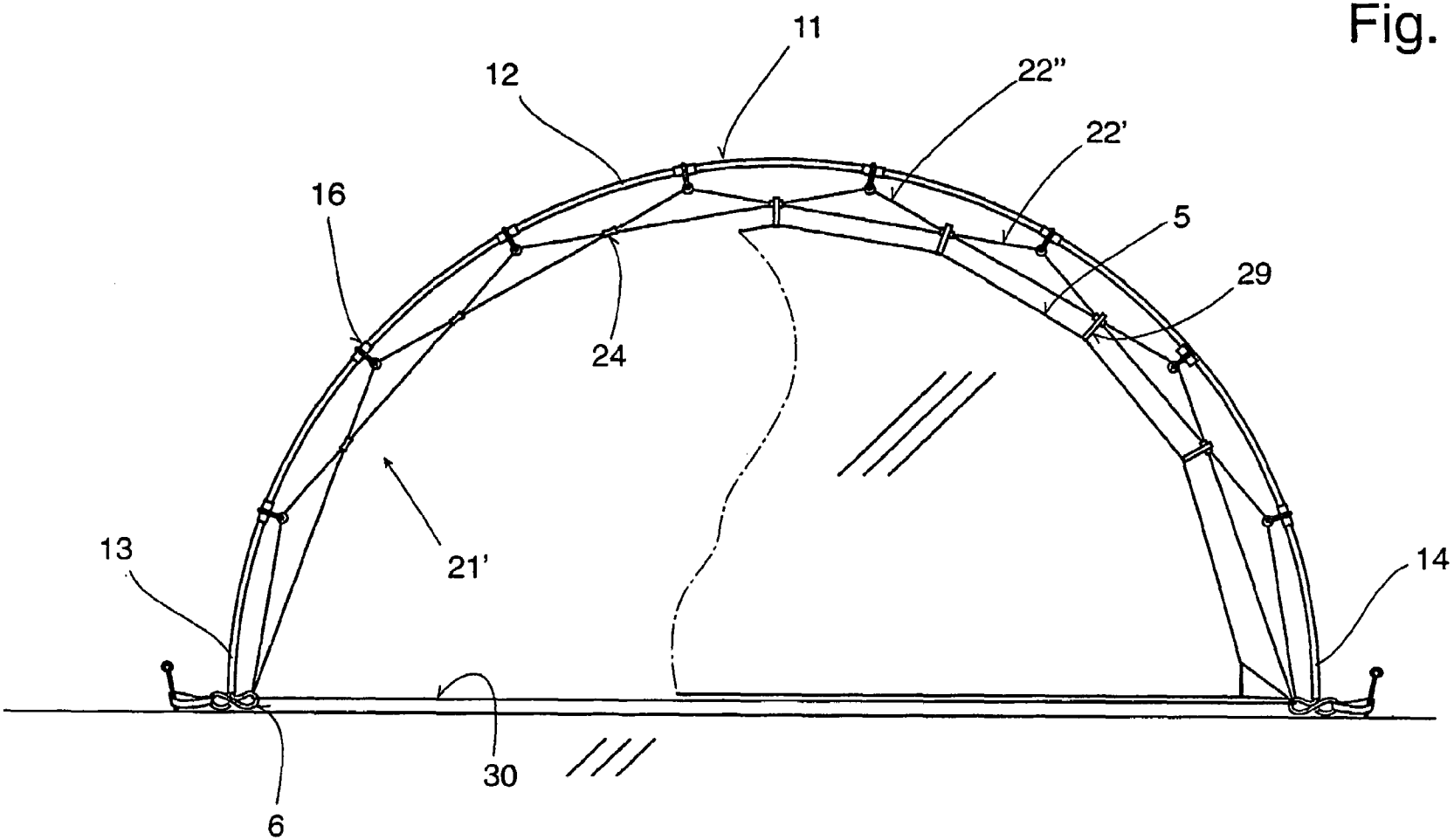

In the embodiments shown in FIGS. 1 and 2, the holding elements 31 enable a tensioning element 21 in the form of a pulling element 22 rigid in the longitudinal direction to be attached to the pole 11, in which case the pulling element 22 can be configured as a cord or a steel cable. In accordance with FIG. 2, the tensioning element 21' comprises two pulling elements 22' and 22" that are attached to alternating intermediate elements 16 of the pole 11. The ends of the tensioning elements 22 or 22', 22" are tensioned by hooks 8 by means of pointed hooks 6 that engage in the outer segments 15 of the arch 12 and to which straps 7 are attached as intermediate elements.

Furthermore, the tensioning elements 21 make it possible to attach an inner tent 5 to the pole 11, it being attached to the tensioning elements 21 by means of straps 29.

To prevent the holding elements 31 in the form of hooks 32 from slipping on the tensioning element 22, they are locked in position by clamping sleeves 23 that are attached to the tensioning element 22 with a slight amount of lateral offset from the holding element 31. In addition, the parts of the tensioning element 21' formed from two tensioning elements 22' and 22" are connected together by a connector 24 at the intersections and tensioned if necessary with the effect that a position-oriented arrangement of the tensioning elements 22' and 22" is guaranteed.

In the embodiment shown in FIGS. 5 and 6, tensioning elements 25 allocated to the pole 11, 11' that forms a combined tent is composed of several triangular pieces of textile fabric 26 that are edged with belt straps 27 by means of which they are firmly connected together, e.g. stitched. The holding element 31' that is also configured as a hook 32' is firmly stitched onto one of the belt straps 25 in this case, which means the holding elements 31' of the tensioning element 25 only have to be hooked into the constrictions 20 in the intermediate elements 16 in order to ensure that the pole will be securely tensioned.

By means of the tensioning elements 21, 21' and 25, the pole 11 can always be tensioned securely and in a straightforward manner, with the effect that a high degree of tensile strength is provided. A tensioning piece 28 inserted in the pulling element 22 of the tensioning element 21 also enables the tension of the pole 11 to be adapted to match the requirements, as shown in FIG. 3. The same effect can also be achieved by a tensioning belt 30 by means of which the two pointed hooks 6 that engage in the ends of the pole 11 are connected together. As a result, secure tensioning can be achieved at all times.

The invention claimed is:

1. A pole assembly for holding and supporting tent sheets, the assembly comprising a plurality of tubular segments connectable together end-to-end to form a pole defining an arch adapted to be supported at ends thereof by a selected one of a base member and a ground portion, wherein said segments are adapted to be connected together by intermediate elements to form the pole, the intermediate elements being adapted to be inserted into said segments, wherein each of the intermediate elements comprises a generally cylindrically shaped part having two ends adapted respectively to engage ends of said segments, the intermediate element ends being offset inwardly and adapted to enter said tubular segments; and a tensioning element adapted to be hung from each of the intermediate elements on an inside of the arch, with said tensioning element comprising a cord adapted to be tensioned against the pole in areas at the ends of the pole against the selected one of the base member and the ground;

wherein said shaped part is provided with a circumferential groove spaced from the ends thereof and adapted to receive an open-sided hook connected to said tensioning element.

2. The pole assembly in accordance with claim 1, wherein said cord comprises a pulling element that is adapted to be taut in a longitudinal direction, and is adapted to be suspended from the intermediate elements of the pole assembly by the hook and is tensioned at the pole ends.

3. The pole assembly in accordance with claim 1, wherein said tensioning element comprises at least two pulling elements that are adapted to be taut in a longitudinal direction, and which are each suspended from alternate intermediate elements of the pole assembly and are tensioned at the ends thereof.

4. The pole assembly in accordance with claim 3, wherein said pulling elements (22) can be fixed on both sides of the holding elements (31) using a selected one of clamping sleeves (23) and cord stoppers that are attached in an adjustable manner.

5. The pole assembly in accordance with claim 3, wherein said pulling elements are attached to a connector at each intersection points of said pulling elements, and are adapted to be tensioned by use of said pulling elements.

6. The pole assembly in accordance with claim 3, wherein said tensioning elements comprise a plurality of pieces of textile fabric triangular in shape, enclosed at least partially by belt straps and connected to one another by the belt straps.

7. The pole assembly in accordance with claim 6, wherein said pieces of textile fabric comprise nets.

8. The pole assembly in accordance with claim 6, wherein the hooks connected to said tensioning elements have open sides engageable with the groove in each of the intermediate elements.

9. The pole assembly in accordance with claim 6, wherein for locking the pole assembly onto the ground or base member, a hook is adapted to be connected to each of end segments of the pole assembly, by means of which the poles are adapted to be anchored, and a tensioning strap is provided connecting ends of the arch poles together and attached to said tensioning elements.

10. The pole assembly in accordance with claim 6, wherein each of said tensioning elements (21, 25) is provided with a tensioning piece (28) for adjusting a level of tension.

* * * * *